US006189990B1

(12) United States Patent
Youn

(10) Patent No.: US 6,189,990 B1
(45) Date of Patent: Feb. 20, 2001

(54) APPARATUS FOR LEAVING SPACE BETWEEN PAPER AND HEAD OF INK-JET PRINTER

(75) Inventor: Suk-Jin Youn, Suwon (KR)

(73) Assignee: Samsung Electronics Co., Ltd., Suwon (KR)

( * ) Notice: Under 35 U.S.C. 154(b), the term of this patent shall be extended for 0 days.

(21) Appl. No.: 08/814,862

(22) Filed: Mar. 10, 1997

(30) Foreign Application Priority Data

Mar. 8, 1996 (KR) ..... 96-4297

(51) Int. Cl.[7] ..... B41J 25/308

(52) U.S. Cl. ..... 347/8; 347/104; 400/630; 400/642

(58) Field of Search ..... 347/8, 104; 400/642, 400/619, 630

(56) References Cited

U.S. PATENT DOCUMENTS

| | | | |
|---|---|---|---|
| 4,682,188 | 7/1987 | Castellano | 347/8 |
| 5,366,301 | 11/1994 | Martin et al. | 400/56 |
| 5,393,151 | 2/1995 | Martin et al. | 400/642 |
| 5,515,094 | 5/1996 | Tanaka et al. | 347/104 |
| 5,527,123 * | 6/1996 | Jackson et al. | 400/642 |
| 5,564,847 * | 10/1996 | Patrick et al. | 400/642 |
| 5,576,744 | 11/1996 | Niikura et al. | 347/14 |
| 5,594,486 * | 1/1997 | Kiyohara | 347/104 |
| 5,608,430 | 3/1997 | Jones et al. | 347/8 |
| 5,738,454 * | 4/1998 | Zepeda et al. | 400/265 |

FOREIGN PATENT DOCUMENTS

4316870 * 11/1992 (JP) .

* cited by examiner

*Primary Examiner*—John Barlow
*Assistant Examiner*—Craig A. Hallacher
(74) *Attorney, Agent, or Firm*—Robert E. Bushnell, Esq.

(57) ABSTRACT

An apparatus for leaving space between paper and a head of an ink-jet printer includes a plurality of paper insertion angle change ribs located in front of a paper guide for controlling the paper raised. The paper guide is mounted at the front side of a deflector guide of the head. Therefore, the angle of the paper inserted to the head is changed, as the place where the paper curls up is changed. As a result, maximum space between the paper and the head is attained. The head is not contacted with the paper, and thus is not stained with ink on the paper so that there is the improvement of reliability of products.

17 Claims, 3 Drawing Sheets

APPARATUS FOR LEAVING SPACE BETWEEN PAPER AND HEAD OF INK-JET PRINTER

CLAIM OF PRIORITY

This application makes reference to, incorporates the same herein, and claims all benefits accruing under 35 U.S.C. §119 from an application entitled Apparatus For Leaving Space Between Paper And Head of Ink-jet Printer earlier filed in the Korean Industrial Property Office on Mar. 8 1996, and there duly assigned Serial No. 96-4297 by that Office.

BACKGROUND OF THE INVENTION

1. Field of the Invention

The present invention relates to an apparatus for leaving space between paper and a head of an ink-jet printer. In particular, the present invention relates to an apparatus preventing the head from inappropriately staining paper with ink by preventing inadvertent contact between the paper and the head.

2. Discussion of Related Art

There are various kinds of paper for printing, such as papers of elasticities of 24 pounds, 20 pounds (regarded as being strong paper) and 16 pounds (regarded as being weak paper). When a paper with weak elasticity is used as a print medium, the head may inappropriately stain the paper with ink. On this matter, exemplars of the contemporary art include U.S. Pat. No. 5,366,301 issued to Martin et al. discussing "a system for use in an ink-jet printer having a printhead and an opposing platen capable of movement toward and away from the printer's printhead to define a record media gap therebetween." The system has a record media detector 24. The detector "includes mounting bosses 24*a* which are captured by hinge member 22*b* so as to pivotally mount the detector to record media guide 22. U.S. Pat. No. 4,682,188 issued to Castellano discusses "a head [which] comprises a closed container carrying internal and external electrodes and a nozzle and is mounted removably on a carriage on which it is held by a permanent magnet in such a way that the head bears with the external electrode against a metal sheet." A protuberance "adjacent to the nozzle" presses against the metal sheet "which in turn presses the paper against a platen." The protuberance establishes "the jet-to-paper spacing." U.S. Pat. No. 5,608,430 issued to Jones et al. discuss "a print head tilt angle positioner [which] includes a scroll cam, a tilt arm, a flexure, a tilt angle adjuster, and a biasing spring." This is part of a machine "to control the distance of the print head from the image receiving drum." U.S. Pat. No. 5,576,744 issued to Niikura et al. discuss "a recording apparatus for recording information with a recording head having a plurality of recording elements while keeping a designated distance between the recording head and a recording medium [which] has an information acquisition device for acquiring distance information between the plurality of recording elements and the recording medium." U.S. Pat. No. 5,515,094 issued to Tanaka et al. discuss "a leaf plate [which] is disposed in abutment, through a guide path of printing paper, with a feed roller whose peripheral surface is in contact with the guide path." By bringing the transported printing paper to the projections, "thus, the distance between the nose portion of the ink jet head and the printing paper in the printing position is made uniform and the quality of printing is improved." U.S. Pat. No. 5,393,151 issued to Martin et al. discuss "a printer mechanism to control pen-to-print medium spacing during printing." The platen includes ribs adapted for "reducing uncontrolled bending of the print medium in the print zone." The ribs "preferably extend parallel" to a direction of travel of the print medium. From my study of these exemplars of the contemporary practice and the art, I find that there is a need for an improved and effective apparatus preventing the head from inappropriately staining paper with ink by preventing inadvertent contact between the paper and the head.

SUMMARY OF THE INVENTION

Accordingly, the present invention is directed to an apparatus for leaving space between paper and a head of an ink-jet printer that substantially obviates one or more of the problems due to limitations and disadvantages of the related art.

The present invention relates to an apparatus for leaving space between paper and a head of an ink-jet printer. In particular, the present invention relates to an apparatus preventing the head from inappropriately staining paper with ink by preventing inadvertent contact between the paper and the head.

An object of the present invention is to provide an apparatus for leaving maximum space between paper and a head of an ink-jet printer, which can prevent the head from being stained with ink on the paper with weak elasticity even if the back part of the paper is raised as the paper is discharged out of the paper discharge roller.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention has a construction that the paper between the deflector guide and the guide roller is made not to be raised by a paper insertion angle change rib, and then passes along the head with space between the paper and the head enough to be in no contact with the head, the deflector guide being installed at the front side of the head. In other words, the paper insertion angle change rib is mounted in front of the guide roller so that the paper may not be raised and uniform space between the paper and the head may be attained.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
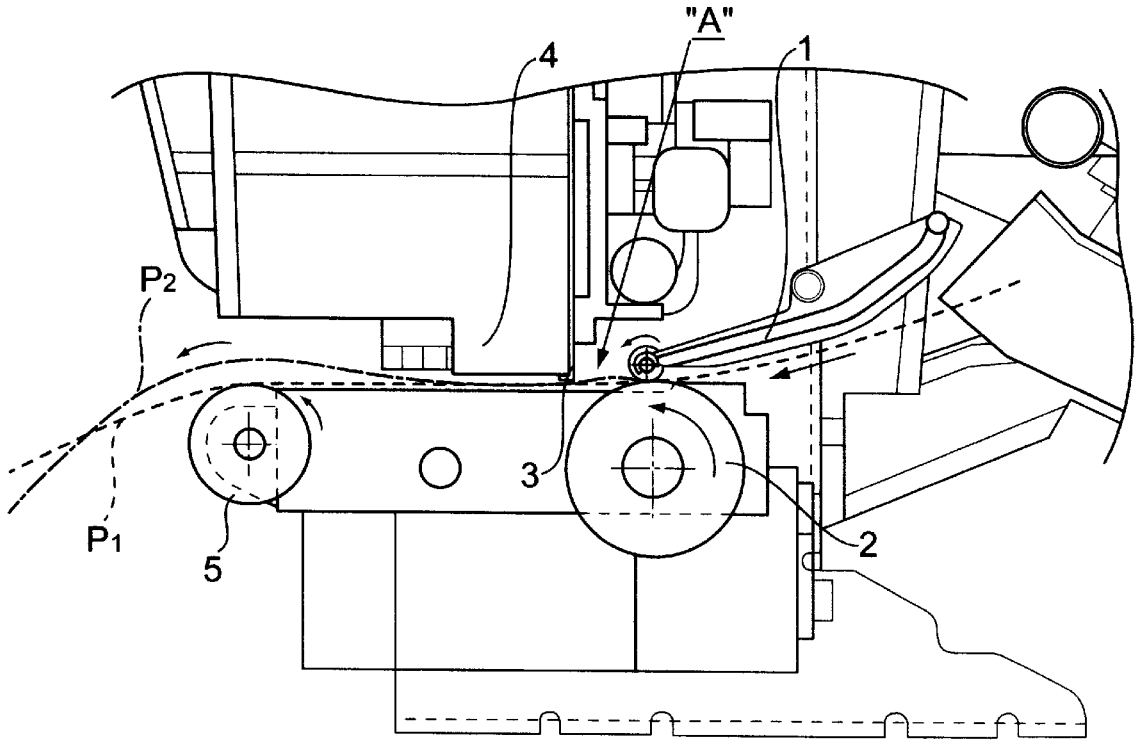
FIG. 1 is a cross-sectional view of a printer having ink-stained related problems.
Figure 2:
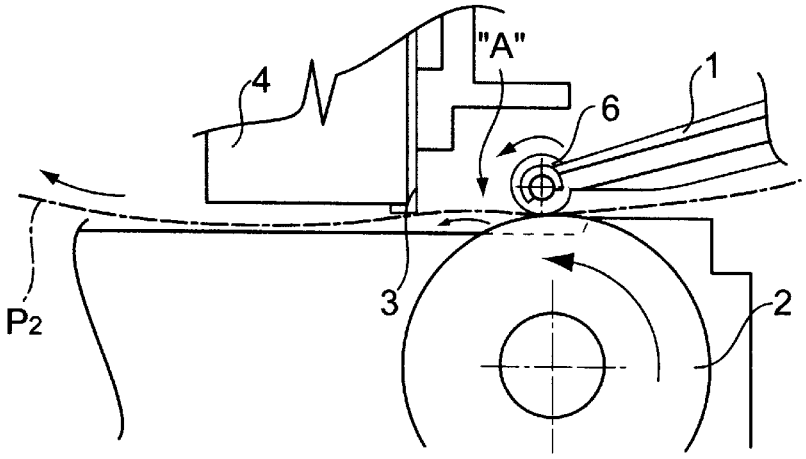
FIG. 2 is a cross-sectional view of an important portion of a printer having ink-stained related problems.

FIGS. 1 and 2 illustrate printers and show the reason why the head stains the paper with ink. A dotted line shows the paper with strong elasticity (hereinafter referred to as "$P_1$"), and a chain line corresponds to the paper with weak elasticity (hereinafter referred to as "$P_2$").

$P_1$ or $P_2$ is conveyed by a feed roller 2, in a state of being guided by a paper guide 1. And during a process in which $P_1$ or $P_2$ passes along a deflector guide 3 and a head 4, $P_1$ or $P_2$ is printed by the head 4. And then, $P_1$ or $P_2$ is discharged through a paper discharge roller 5.

Accordingly, there is no blur of ink in case of $P_1$ because of its strong elasticity. However, when $P_2$ is used, $P_2$ is raised at a place A between a guide roller 6 and the deflector guide 3, and then is contacted with the head 4 so that the head 4 stains the paper $P_2$. This is because the back part of $P_2$ is highly raised due to its weak elasticity when the front part of $P_2$ is discharged out of the paper discharge roller 5, and hangs down. As a result, $P_2$ located at place A is raised without any control member, and contacted with the head 4. The head 4 stains the paper $P_2$.

Figure 3:
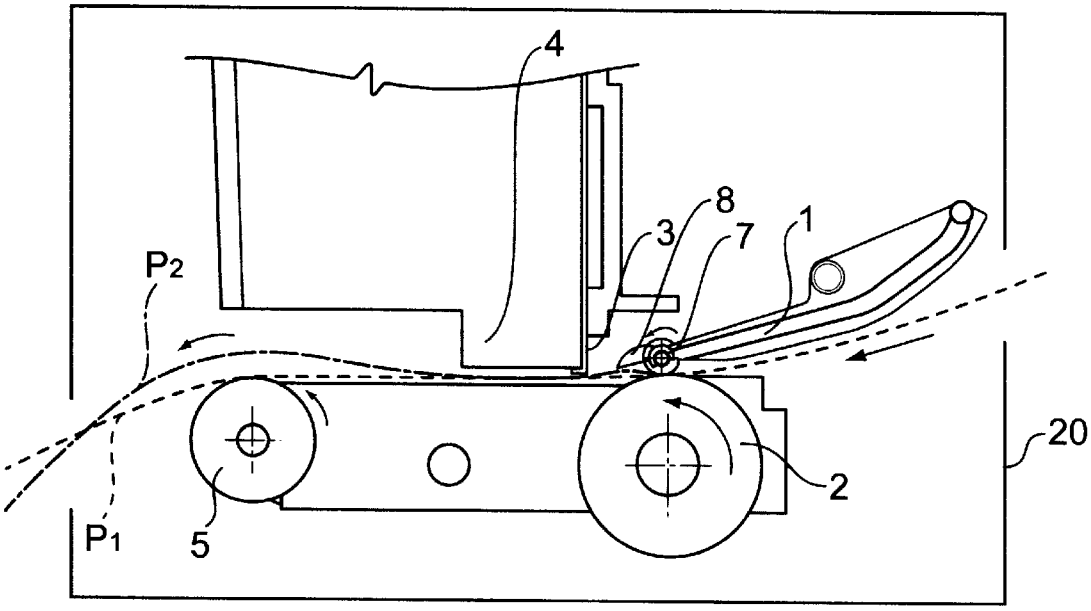
FIG. 3 is a cross-sectional view a printer, in accordance with the principles of the present invention.
Figure 4:
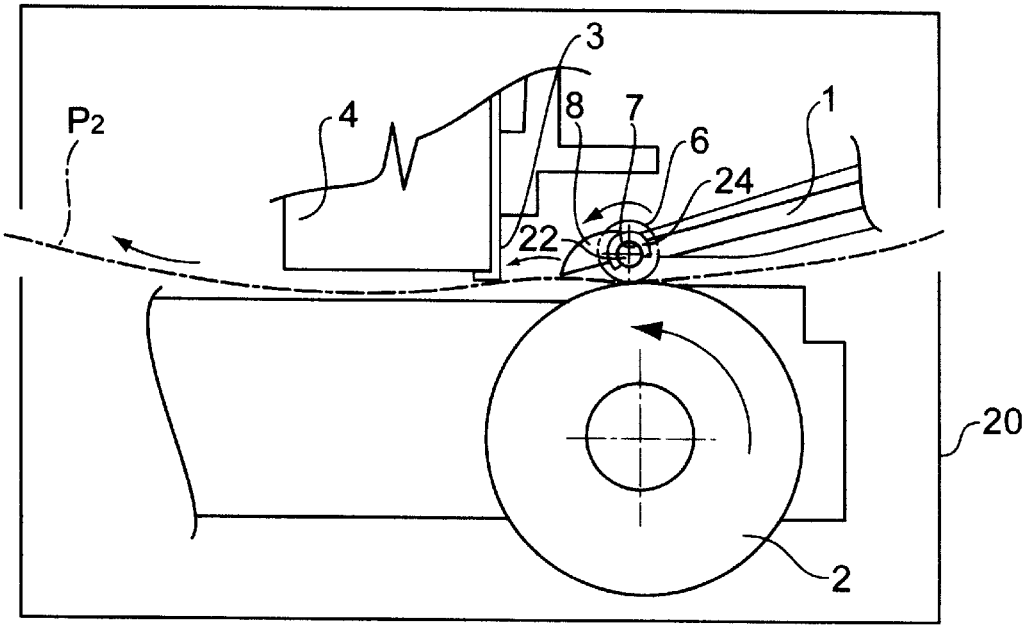
FIG. 4 is a magnified cross-sectional view of the printer of FIG. 3, in accordance with the principles of the present invention.

FIGS. 3 and 4 illustrate the preferred embodiments of the present invention. FIG. 3 shows a cross-sectional view of a printer having a body 20, in accordance with the principles of the present invention. FIG. 4 shows a magnified cross-sectional view of the printer having a body 20 illustrated in FIG. 3.

Paper sheet, $P_1$ or $P_2$ is conveyed by a feed roller 2 along a paper guide 1 and guided to a deflector guide 3. And during a process in which $P_1$ or $P_2$ passes along a head 4, $P_1$ or $P_2$ is printed by the head 4. And then, $P_1$ or $P_2$ is discharged through a paper discharge roller 5. Additionally, a guide roller 6 is mounted in the printer body 20 at a location over the feed roller 2.

Especially, the apparatus comprises a plurality of protruding paper insertion angle change ribs 8 with a guide roller shaft insertion hole 7. A guide roller shaft 22 is inserted into hole 7, as shown in FIG. 4.

The paper insertion angle change ribs 8 are integrally formed with the paper guide 1, while being inclined downwards and protruding in front of the feed roller 2 and the guide roller 6.

Image data is printed onto paper $P_2$ is printed by the printhead 4, discharged out of the paper discharge roller 5, and then raised at a place between the feed roller 2 and the deflector guide 3. Here, the paper insertion angle change ribs 8 control $P_2$ raised so that $P_2$ passing along the deflector guide 3 is inserted to the head 4 at a decreased angle.

Figure 5:
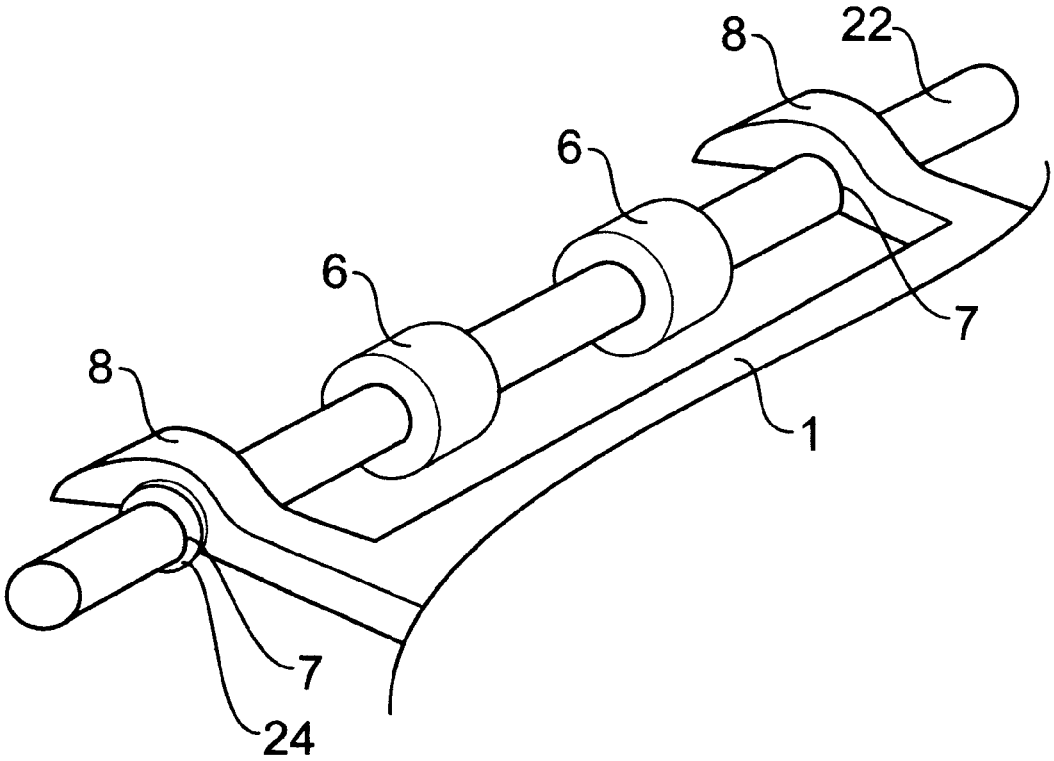
FIG. 5 is a view of the ribs shown in FIG. 4, in accordance with the principles of the present invention.

Therefore, because maximum space between $P_2$ and the head 4 is attained and a place where $P_2$ curls up is changed, the head 4 does not stain paper $P_2$ with ink when $P_2$ is discharged out of the printer using paper discharge roller 5. FIG. 5 shows ribs 8, shaft hole 7, shaft 22, paper guide 1, guide roller 6, and washer 24.

In accordance with the above description, the head is not contacted with the paper with weak elasticity, and thus does not stain the paper with ink so that the improvement in reliability of products can be attained by the present invention. The printer body 20 corresponds to an ink-jet printer having a feed roller 2 conveying paper along a paper guide 1 and guiding the paper to a deflector guide 3, a guide roller 6 mounted over said feed roller 2 and supported by a guide roller shaft 21, a paper discharge roller 5 discharging the paper, a print head 4 forming images on the paper when the paper passes along said print head 4, by jetting ink, and a rib device maintaining space between the paper and said print head 4, said rib device having a plurality of paper insertion angle change ribs 8, each rib 8 being inclined at a downward angle, said rib device having a guide roller shaft insertion hole 7 receiving the guide roller shaft 21. The feed roller 2, paper guide 1, deflector guide 3, guide roller 6, shaft 21, discharge roller 5, ribs 8, and print head 4 are all mounted in a cooperative manner within printer body 20, as described above.

Additionally, a simple construction such as that of the present invention prevents manufacturing costs from rising, without adversely affecting the assembly times and without adversely affecting overall productivity and efficiency.

It will be apparent to those skilled in the art that various modifications and variations can be made in an apparatus for leaving space between paper and a head of an ink-jet printer of the present invention without departing from the spirit or scope of the invention. Thus, it is intended that the present invention cover the modifications and variations of this invention provided they come within the scope of the appended claims and their equivalents.

What is claimed is:

1. An ink-jet printer, comprising:

a feed roller being rotatably mounted in a body of said printer, said feed roller receiving a recordable medium, said feed roller transporting the recordable medium along a path of conveyance through the body of said printer;

a guide being positioned in the body of said printer at a location adjacent to said feed roller, said guide guiding the recordable medium along the path of conveyance, said guide forming an aperture;

a guide roller being rotatably mounted in the body of said printer adjacent to said feed roller;

a shaft being coupled to the body of said printer, being fitted loosely into the aperture of said guide, and rotatably supporting said guide roller adjacent to said feed roller, said feed roller and guide roller being positioned to form a nip between said feed roller and said guide roller, said guide roller being mounted to said shaft;

a discharge roller being rotatably mounted in the body of said printer and discharging the recordable medium from the body of said printer;

a print head being positioned in the body of said printer along the path of conveyance between the nip and said discharge roller, said print head forming images upon a surface of the recordable medium while the recordable medium is transported along the path of conveyance;

a plurality of ribs each being integrally formed with said guide, each respective rib having a first end inclined at an angle from said shaft toward the path of conveyance, each respective rib having a second end forming the aperture into which said shaft is fitted loosely, said first end of each of said ribs being movably positioned between the nip and said print head to engage a region of the surface of the recordable medium while the recordable medium is being transported along the path of conveyance, said plurality of ribs engaging said region of the recordable medium before said print head forms images on said region of the recordable medium; and a deflector guide being fixedly mounted between said print head and said plurality of ribs and along the path of conveyance, said deflector guide deflecting the recordable medium being transported along the path of conveyance and causing the recordable medium to stay on the path of conveyance before said print head forms the images upon the surface of the recordable medium;

said first end of each of said plurality of ribs contacting the recordable medium and minimizing a marginal bow in the recordable medium at a location between said feed roller and said deflector guide while the recordable medium is transported along the path of conveyance.

2. The ink-jet printer of claim 1, further comprising said first end of each of said plurality of ribs and said deflector guide being positioned to cause the recordable medium to be oriented to prevent the recordable medium from inadvertently contacting said print head after said print head forms the images upon the surface of the recordable medium.

3. The ink-jet printer of claim 1, further comprising said guide guiding the recordable medium along the path of conveyance through the nip between said feed roller and said guide roller.

4. The ink-jet printer of claim 3, further comprising said first end of each of said plurality of ribs and said deflector guide being positioned to cause the recordable medium to be oriented to prevent the recordable medium from inadvertently contacting said print head after said print head forms the images upon the surface of the recordable medium.

5. The ink-jet printer of claim 4, further comprising said plurality of ribs causing the recordable medium to pass close to said deflector guide.

6. The ink-jet printer of claim 1, further comprising said plurality of ribs extending toward the path of conveyance from said shaft.

7. An apparatus, comprising:

a first plurality of rollers being mounted in a body of said apparatus, said first plurality of rollers forming a nip, said first plurality of rollers receiving a recordable medium at the nip and transporting the recordable medium along a path of conveyance through the body;

a guide being mounted in the body at a location adjacent to said first plurality of rollers, said guide guiding the recordable medium along the path of conveyance, said guide forming an aperture;

a shaft being attached to the body and being fitted loosely into the aperture of said guide to support said guide adjacent to said first plurality of rollers;

a discharge roller being mounted in the body and discharging the recordable medium from the body;

a print head being positioned in the body along the path of conveyance between the nip and said discharge roller, said print head forming images upon a surface of the recordable medium while the recordable medium is transported along the path of conveyance;

a plurality of ribs each being integrally formed with said guide, each respective rib having a first end inclined at an angle from said shaft toward the path of conveyance, each respective rib having a second end forming the aperture into which said shaft is fitted loosely, said first end of each of said ribs being movably positioned between the nip and said print head to engage a region of the surface of the recordable medium while the recordable medium is being transported along the path of conveyance, said plurality of ribs engaging said region of the recordable medium before said print head forms images on said region of the recordable medium; and a deflector guide being mounted between said print head and said plurality of ribs and along the path of conveyance, said deflector guide deflecting the recordable medium being transported along the path of conveyance and causing the recordable medium to stay on the path of conveyance;

said first end of each of said plurality of ribs contacting the recordable medium and minimizing a marginal bow in the recordable medium at a location between said first plurality of rollers and said deflector guide while the recordable medium is transported along the path of conveyance.

8. The apparatus of claim 7, further comprising said first end of each of said plurality of ribs and said deflector guide being positioned to cause the recordable medium to be oriented to prevent the recordable medium from inadvertently contacting said print head after said print head forms the images upon the surface of the recordable medium.

9. The apparatus of claim 7, further comprising said guide guiding the recordable medium along the path of conveyance through the nip formed by said first plurality of rollers.

10. The apparatus of claim 9, further comprising said first end of each of said plurality of ribs and said deflector guide being positioned to cause the recordable medium to be oriented to prevent the recordable medium from inadvertently contacting said print head after said print head forms the images upon the surface of the recordable medium.

11. The apparatus of claim 10, further comprising said plurality of ribs causing the recordable medium to pass close to said deflector guide.

12. The apparatus of claim 7, further comprising said plurality of ribs extending toward the path of conveyance from said shaft.

13. A printer, comprising:

a roller unit being mounted in a body of said printer, said roller unit receiving a recordable medium and transporting the recordable medium along a path of conveyance through the body;

a guide being mounted in the body at a location adjacent to said roller unit, said guide guiding the recordable medium along the path of conveyance, said guide forming an aperture;

a shaft being attached to the body and being fitted loosely into the aperture of said guide to support said guide adjacent to said roller unit;

a print head being positioned in the body along the path of conveyance between said roller unit and an end of the path of conveyance where the recordable medium is discharged from the body of the printer, said print head forming images upon a surface of the recordable medium while the recordable medium is transported along the path of conveyance;

a plurality of ribs each being integrally formed with said guide, each respective rib having a first end inclined at an angle from said shaft toward the path of conveyance, each respective rib having a second end forming the aperture into which said shaft is fitted loosely, said first end of each of said ribs being movably positioned between said roller unit and said print head to engage a region of the surface of the recordable medium while the recordable medium is being transported along the path of conveyance, said plurality of ribs engaging said region of the recordable medium before said print head forms images on said region of the recordable medium; and a deflector guide being mounted between said print head and said plurality of ribs and along the path of conveyance, said deflector guide deflecting the recordable medium being transported along the path of conveyance and causing the recordable medium to stay on the path of conveyance;

said first end of each of said plurality of ribs contacting the recordable medium and minimizing a marginal bow in the recordable medium at a location between said roller unit and said deflector guide while the recordable medium is transported along the path of conveyance.

14. The printer of claim 13, further comprising said first end of each of said plurality of ribs and said deflector guide being positioned to cause the recordable medium to be oriented to prevent the recordable medium from inadvertently contacting said print head after said print head forms the images upon the surface of the recordable medium.

15. The printer of claim 13, further comprising said guide guiding the recordable medium along the path of conveyance through said roller unit.

16. The printer of claim 15, further comprising said first end of each of said plurality of ribs and said deflector guide being positioned to cause the recordable medium to be oriented to prevent the recordable medium from inadvertently contacting said print head after said print head forms the images upon the surface of the recordable medium.

17. The printer of claim 16, further comprising said plurality of ribs causing the recordable medium to pass close to said deflector guide.

* * * * *